US010642176B2

(12) United States Patent
Ha et al.

(10) Patent No.: US 10,642,176 B2
(45) Date of Patent: May 5, 2020

(54) PHOTOSENSITIVE BODY INCLUDING PROTECTIVE LAYER FORMED ON PHOTOSENSITIVE LAYER

(71) Applicant: HEWLETT-PACKARD DEVELOPMENT COMPANY, L.P., Spring, TX (US)

(72) Inventors: Young-soo Ha, Suwon (KR); Sung-hoon Kang, Suwon (KR); Yong-jun Kwon, Suwon (KR); Seung-ju Kim, Suwon (KR); So-hyeon An, Suwon (KR); Hun Jung, Suwon (KR); Il-sun Hwang, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/958,810

(22) Filed: Apr. 20, 2018

(65) Prior Publication Data

US 2018/0239248 A1 Aug. 23, 2018

Related U.S. Application Data

(63) Continuation of application No. PCT/KR2016/010816, filed on Sep. 27, 2016.

(30) Foreign Application Priority Data

Oct. 21, 2015 (KR) ..... 10-2015-0146854

(51) Int. Cl.
*G03G 5/147* (2006.01)
*G03G 5/07* (2006.01)

(52) U.S. Cl.
CPC ..... *G03G 5/14734* (2013.01); *G03G 5/076* (2013.01); *G03G 5/14704* (2013.01); *G03G 5/14708* (2013.01); *G03G 5/14747* (2013.01); *G03G 5/14769* (2013.01); *G03G 5/14791* (2013.01); *G03G 5/14795* (2013.01)

(58) Field of Classification Search
CPC ..... G03G 5/14734; G03G 5/14708; G03G 5/14704; G03G 5/147; G03G 5/14717; G03G 5/14713; G03G 5/14791; G03G 5/14769; G03G 5/14747
USPC ..... 430/66, 67
See application file for complete search history.

(56) References Cited

U.S. PATENT DOCUMENTS

| | | | | |
|---|---|---|---|---|
| 5,374,494 | A * | 12/1994 | Kashimura | G03G 5/0592 358/296 |
| 2008/0102391 | A1 | 5/2008 | Yanagawa et al. | |
| 2008/0199217 | A1 | 8/2008 | Iwamoto et al. | |
| 2009/0081569 | A1 | 3/2009 | Miyamoto et al. | |
| 2013/0149540 | A1 | 6/2013 | Sato et al. | |
| 2014/0377695 | A1* | 12/2014 | Kameyama | G03G 5/14726 430/96 |
| 2015/0253720 | A1 | 9/2015 | Kurimoto et al. | |
| 2015/0284603 | A1 | 10/2015 | Iwai et al. | |
| 2016/0187793 | A1* | 6/2016 | Takezawa | G03G 5/043 430/56 |

FOREIGN PATENT DOCUMENTS

| | | | | |
|---|---|---|---|---|
| JP | 08184980 | | 7/1996 | |
| JP | 2007322483 | | 12/2007 | |
| JP | 2012128324 | | 7/2012 | |
| JP | 2014081603 | | 5/2014 | |
| WO | WO-2017069420 | A1 * | 4/2017 | G03G 5/14734 |

OTHER PUBLICATIONS

Diamond, A.S., ed. Handbook of Imaging Materials, Marcel Dekker, Inc., NY (1991), pp. 395-396 (Year: 1991).*

* cited by examiner

*Primary Examiner* — Janis L Dote
(74) *Attorney, Agent, or Firm* — Staas & Halsey LLP

(57) ABSTRACT

A photosensitive body is provided. The photosensitive body includes a photosensitive layer, and a protective layer formed on the photosensitive layer, and the protective layer includes a urethane oligomer acrylate and a modified perfluoropolyether acrylate.

12 Claims, 2 Drawing Sheets

【Figure 1】
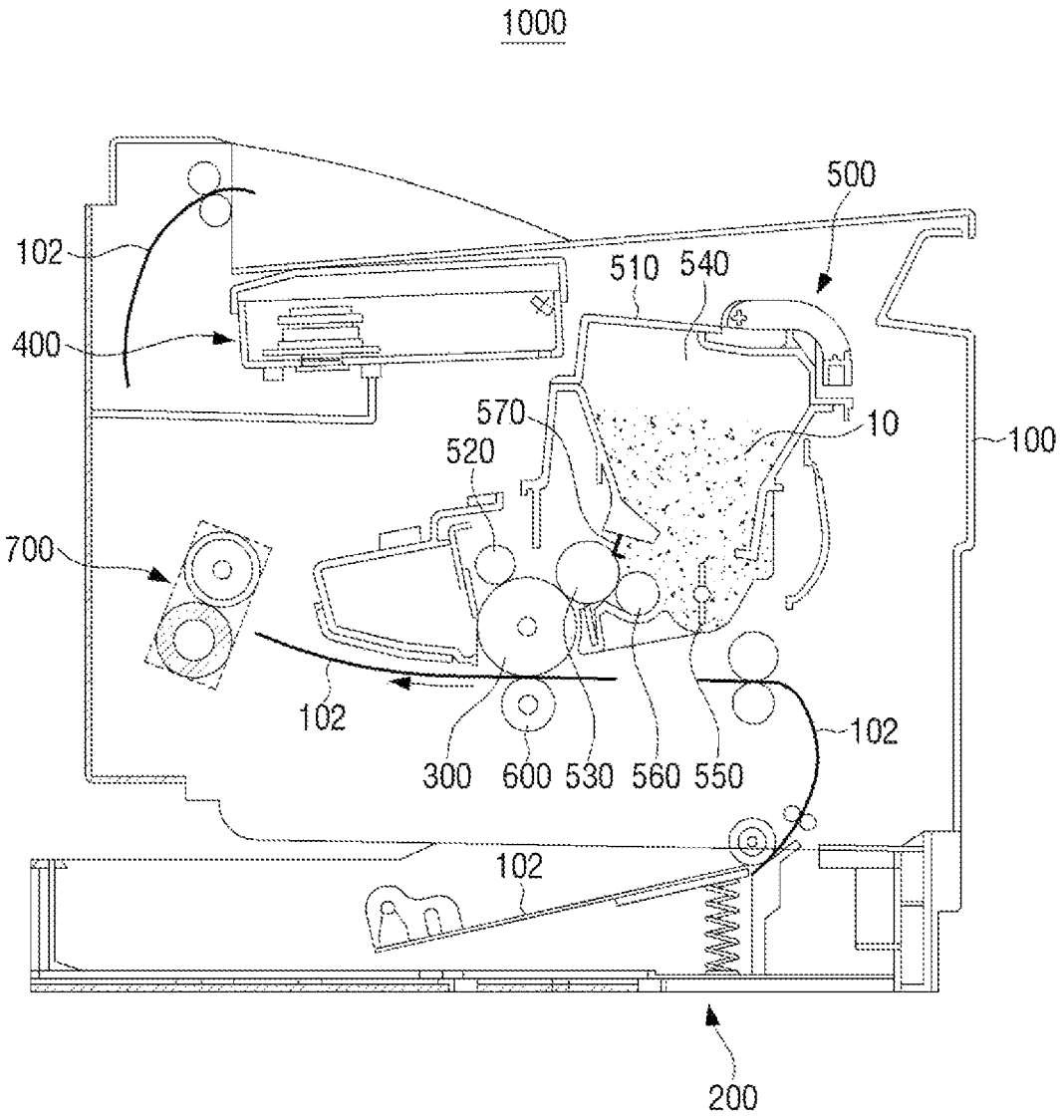

【Figure 2】
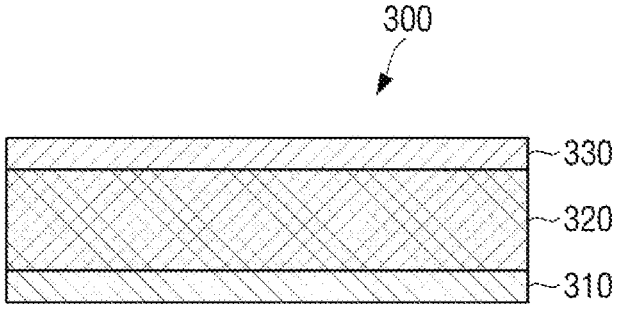
【Figure 3】
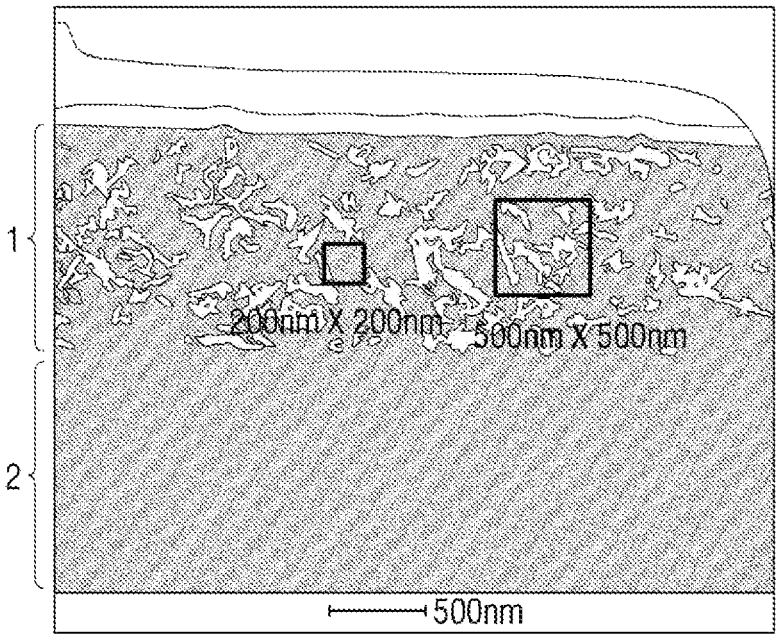

PHOTOSENSITIVE BODY INCLUDING PROTECTIVE LAYER FORMED ON PHOTOSENSITIVE LAYER

CROSS-REFERENCE TO RELATED APPLICATIONS

This application is continuation application of International Patent Application No. PCT/KR2016/010816, filed on Sep. 27, 2016, which claims priority from Korean Patent Application No. 10-2015-0146854, filed on Oct. 21, 2015, in the Korean Intellectual Property Office.

BACKGROUND

In general, an electrophotographic image forming apparatus such as a laser printer, a facsimile and a photocopier includes a photosensitive body, and a charging roller, a developing roller, a transfer roller and the like installed on the circumference of the photosensitive body. A developing agent supplied from a developing device is moved by voltage applied to a photosensitive body, a charging roller, a developing roller or a transfer roller to form a predetermined image in a printed medium.

For example, a charging roller charges the surface of a photosensitive body with a predetermined voltage, and light scanned in a light exposure unit forms an electrostatic latent image corresponding to print data on the charged surface of the photosensitive body. Then, a developing roller supplies the photosensitive body with a developing agent to develop the electrostatic latent image into a developing agent image. The developing agent image is transferred to a print medium passing between the photosensitive body and a transfer roller by the transfer roller.

BRIEF DESCRIPTION OF THE DRAWINGS

FIG. 1 is a drawing for describing an internal configuration of an image forming apparatus according to an example of the present disclosure;

FIG. 2 is a cross-sectional view for describing a photosensitive body according to an example of the present disclosure; and FIG. 3 is an SEM (scanning electron microscope) image of a photosensitive body according to an example of the present disclosure.

DETAILED DESCRIPTION

The present examples may be variously modified and have various other examples. Therefore, examples will be illustrated in the accompanying drawings and be described in detail in the detailed description. However, it is to be understood that the scope is not limited to any example, but all modifications, equivalents, and substitutions included in the disclosed spirit and technical scope are included. Further, when it is determined in the description of the examples that the detailed description of the related art may obscure the gist, the detailed description thereof will be omitted.

Terms used in the specification, 'first', 'second', etc. may be used to describe various components, but the components are not to be interpreted to be limited to the terms. The terms are only used to differentiate one component from other components.

Terms used in the present application are used only in order to describe specific examples rather than limiting the scope of a right. Singular forms are intended to include plural forms unless otherwise indicated contextually. It will be further understood that the terms "comprise" or "configured" used in this specification, specify the presence of stated features, steps, operations, components, parts, or a combination thereof, but do not preclude the presence or addition of one or more other features, numerals, steps, operations, components, parts, or a combination thereof.

The photosensitive body may be influenced by electrical external force by charging, light exposure, development, transfer, cleaning or the like, and mechanical external force by a charging roller, a cleaning blade or the like, and thus, may need durability. In addition, durability against deterioration of potential characteristics by ozone or charging product produced from charging, or the like may also be needed. FIG. 1 illustrates an image forming apparatus in which the photosensitive body according to an example of the present disclosure may be used.

Referring to FIG. 1, as represented in FIG. 1, the image forming apparatus 1000 according to an example of the present disclosure includes a body case 100, and a paper supplier 200, a photosensitive body 300, an optical scanner 400, a development cartridge 500, a transfer roller 600, and a fixer 700.

The body case 100 forms the exterior of the image forming apparatus 1000. The paper supplier 200 is provided inside of the body case 100, and in this paper supplier 200, paper 102 is loaded.

The photosensitive body 300 has a cylindrical drum shape extended to a predetermined length to correspond to the width of the paper 102. The photosensitive body 300 is charged at constant polarity potential by a charging roller 520. On the photosensitive body 300 of which the outer circumferential surface is evenly charged, an electrostatic latent image by potential difference is formed by a beam scanned from the optical scanner 400. To the electrostatic latent image, a toner 10 is supplied by a developing roller 530, and the image by the toner 10 is transferred on the paper 102 passing between the photosensitive body 300 and the transfer roller 600.

The optical scanner 400 scans a beam corresponding to the image data to be formed on the paper 102 to the photosensitive body 300, thereby forming the electrostatic latent image on the photosensitive body 300. The optical scanner 400 may include a laser scanner using a laser diode as a light source, and besides, light sources having various shapes may replace the laser scanner.

The development cartridge 500 supplies the toner 10 which is a developing agent to the electrostatic latent image of the photosensitive body 300. The development cartridge 500 includes a cartridge case 510, and the charging roller 520, the developing roller 530, a toner storage 540, a hopper 550, a feed roller 560, and a regulating blade 570.

The charging roller 520 rotates in contact with the photosensitive body 300, and charges the surface of the photosensitive body 300 at a uniform potential value. The developing roller 530 supplies the toner 10 to the electrostatic latent image formed on the photosensitive body 300. The toner storage 540 is formed inside of the cartridge case 510, and the toner 10 is stored therein. The hopper 550 is provided in the toner storage 540. The feed roller 560 is provided in the toner storage 540, and supplies the toner 10 to the developing roller 530. The regulating blade 570 is extended from the toner storage 540 to be in contact with the developing roller 530. The charging roller 520 is provided inside of the cartridge case 510, and rotates in contact with the photosensitive body 300. To the charging roller 520, a charging bias is applied to charge the outer circumferential surface of the photosensitive body 300 at the same potential value. When a beam from the optical scanner 400 is scanned to the photosensitive body 300 charged at the same potential value by the charging roller 520, at the point where the beam is scanned, the potential value is changed due to the photoconductive property of the photosensitive body 300. Therefore, a potential difference occurs between the point where the beam is scanned and the point where the beam is not scanned, thereby forming an electrostatic latent image on the photosensitive body 300 by the potential difference. The developing roller 530 is installed close to the toner storage 540 to rotate in an opposite direction to the rotation direction of the photosensitive body 300. The developing roller 530 to which a developing bias is applied rotates in contact with the feed roller 560, and the toner 10 from the feed roller 560 is attached thereto by the potential difference with the feed roller 560. The developing roller 530 to which the toner 10 is attached rotates in contact with the photosensitive body 300, so that the attached toner 10 is supplied to the electrostatic latent image of the photosensitive body 300. The toner storage 540 is formed as a housing space for storing the toner 10 inside of the cartridge case 510. In the toner storage 540, one side where the developing roller 530 is provided is opened, thereby supplying the stored toner 10 to the developing roller 530 by the feed roller 560. At least one hopper 550 is installed in the toner storage 540. The hopper 550 rotates in the toner storage 540, conveys the toner 10 toward the feed roller 560, and stirs the toner 10, thereby preventing solidification of the toner 10 and improving flowability. In addition, the hopper 550 stirs the toner 50, thereby allowing the toner 10 to be charged at a predetermined potential value. The feed roller 560 is provided on the lower side of the toner storage 540 to rotate in contact with the developing roller 530. The feed roller 560 supplies the toner 10 conveyed by the hopper 550 to the developing roller 530. The feed roller 560 rotates in the same direction as the developing roller 530, that is, in a crossing direction to each other. In this way, the toner 10 passing between the feed roller 560 and the developing roller 530 to receive frictional force is charged at a predetermined potential value and simultaneously attached to the developing roller 530 in an appropriate amount. The regulating blade 570 is in contact with the developing roller 530 with a predetermined pressurizing force. In this way, the regulating blade 570 secures the uniformity of the amount of the toner 10 supplied from the feed roller 560 and attached to the developing roller 530, that is, the mass of the toner 10 per unit area of the developing roller 530 (M/A [g/cm$^2$]). In addition, the regulating blade 570 charges the toner 10 attached to the developing roller 530 at a predetermined potential value. For this, the regulating blade 570 may be provided to include a conductive material, and have a constant potential value by applying a power supply thereto.

The transfer roller 600 rotates in contact with the photosensitive body 300 so that an image by the toner 10 is transferred on the paper 102. The fixer 700 fixes the image by the toner 10 on the paper 102.

FIG. 2 is a drawing representing a cross section of the photosensitive body according to an example of the present disclosure.

Referring to FIG. 2, the photosensitive body 300 includes a support 310, a photosensitive layer 320, and a protective layer 330.

The support 310 may be formed of a conductive material. For example, metal materials such as aluminum, an aluminum alloy, copper, zinc, silver, gold, stainless steel and titanium may be used. In addition, the metal materials are not limited thereto, but a product obtained by laminating or depositing a metal film such as films of aluminum, an aluminum alloy, copper, zinc, silver, gold, stainless steel or titanium, or depositing or coating a layer of a conductive metal oxide such as a conductive polymer, tin oxide, indium oxide or indium tin oxide, on the surface of polyester such as polyethylene terephthalate, nylon such as nylon 6 and nylon 66, and polymer materials such as polystyrene, polycarbonate, a phenol resin and polyimide, hard paper, glass, or the like, may be used. Otherwise, a conductive path formed by including the particles of the metal material or the conductive metal oxide in the polymer material may be used.

The shape of the support 310 may be a cylindrical or endless belt shape, or the like.

The surface of the support 310 may if necessary, undergo positive electrode oxide coat treatment, surface treatment by chemicals, hot water or the like, coloring treatment, or diffuse treatment such as roughening the surface, to the extent not affecting image quality. In the electrophotographic process using laser as a light exposure source, incident laser light and reflected light in an organic photosensitive body cause interference, and an interference pattern by this interference occurs on the image to cause an image defect. By carrying out the above-described treatment on the surface of the support 310, the image defect by the interference of laser light may be prevented.

According to another example of the present disclosure, an intermediate layer may be further included to maintain the electrical properties of the photosensitive body between the photosensitive layer 320 and the support 310. The intermediate layer is formed on the support 310, and serves to improve image characteristics by hole injection inhibition, improve adhesion of the support 310 and the photosensitive layer 320, prevent dielectric breakdown of the photosensitive layer, or the like.

The photosensitive layer 320 may be formed of a laminated structure of a charge generation layer containing a charge generating material, and a charge transport layer containing a charge transporting material. As such, each layer is responsible for a charge generation function and a charge transport function, thereby selecting an optimal material for each function of charge generation and charge transport. Therefore, a photosensitive body having higher sensitivity and high durability with excellent stability during repeated use may be obtained.

The charge generation layer may contain a charge generating material to generate charge by absorbing light as a main component.

As a material that can be effective for the charge generating material, an azo-based pigment such as a monoazo-based pigment, a bisazo-based pigment and a trisazo-based pigment; an indigo-based pigment such as indigo and thioindigo; a perylene-based pigment such as perylene imide and perylenic acid anhydride; a polycyclic quinone-based pigment such as anthraquinone and pyrenequinone; a phthalocyanine-based pigment such as metal phthalocyanine and non-metal phthalocyanine; a squarylium coloring agent; pyrylium dyes and thiopyrylium dyes; a triphenylmethane-based coloring agent; inorganic materials such as selene and amorphous silicon, and the like may be used. These charge generating materials may be used alone or in combination of two or more.

The charge generation layer may have a film thickness of about 0.05 μm or more and about 5 μm or less, specifically about 0.1 μm or more and about 1 μm or less. When the charge generation layer has a film thickness less than about 0.05 μm, light absorption efficiency is reduced to lower sensitivity. When the charge generation layer has a film thickness more than about 5 μm, charge transfer inside of the charge generation layer becomes a rate limiting step of a process of eliminating charge on the surface of the photosensitive body, thereby decreasing sensitivity.

The charge transport layer contains a charge transport material having a transport ability by accepting charge generated in the charge generating material.

As the charge transport material, a carbazole derivative, a butadiene derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a polycyclic aromatic compound, an indole derivative, a pyrazoline derivative, an oxazolone derivative, a benzimidazole derivative, a quinazoline derivative, a benzofuran derivative, an acridine derivative, a phenazine derivative, an amino stilbene derivative, a triarylamine derivative, a triarylmethane derivative, a phenylenediamine derivative, a stilbene derivative, a benzidine derivative, and the like may be listed. In addition, a polymer having a moiety derived from these compounds in the straight chain or branched chain, for example, poly-N-vinyl carbazole, poly-1-vinylpyrene, poly-9-vinylanthracene and the like may be used.

The protective layer 330 is formed to protect the photosensitive layer.

Specifically, the protective layer 330 may be formed by coating a protective layer composition solution formed of a photocurable compound, a conductive material, a photoinitiator, a solvent and the like on the surface of the photosensitive layer 320, and then carrying out photocuring by a ultraviolet curing device.

As the photocurable compound, a monomer or oligomer having a functional group such as a crosslinkable unsaturated bond group may be used. The functional group refers to a group involved in a photocuring reaction, that is, a crosslinking reaction by UV irradiation.

An example of this photocurable compound may include a urethane acrylate, a polyester acrylate, a dipentacrythritol hexaacrylate, a dipentacrythritol pentaacrylate, a pentacrythritol tetraacrylate, a dipentaerythritol hexaacrylate, a dipentaerythritol pentaacrylate, and the like. Meanwhile, the acrylate mentioned in the present specification includes acrylates and methacrylates.

In particular, the protective layer 330 according to the present disclosure includes a urethane oligomer acrylate and a modified perfluoropolyether acrylate, as the photocurable compound.

The urethane oligomer acrylate contains two or more functional groups in addition to a urethane bond.

In this case, the urethane oligomer acrylate is an aliphatic urethane oligomer acrylate which does not contain a hydroxyl group. This is because when there is a functional group having hydrophilicity, a curing degree may be lowered by the influence of oxygen on the surface during the photocuring process, or a missing or blurred image may be caused by humidity in high temperature and high humidity environment. That is, the protective layer, for example, has hydrophobicity for missing or blurred images or dot reproducibility improvement.

The aliphatic urethane oligomer acrylate having no hydroxyl group may be, for example, a urethane oligomer having a radical polymerizable functional group such as an acryloyloxy group or a methacryloyloxy group. The urethane oligomer having an acryloyloxy group may be obtained by, for example, reacting polyisocyanate and polyol having an acryloyloxy group. For example, a compound of the polyisocyanate is represented by the following Compounds A to C, and a compound of the polyol materials is represented by the following Compounds D to F, but not limited thereto:

[Compound A]

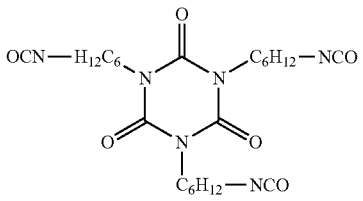

[Compound B]

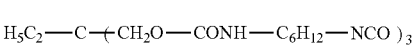

[Compound C]

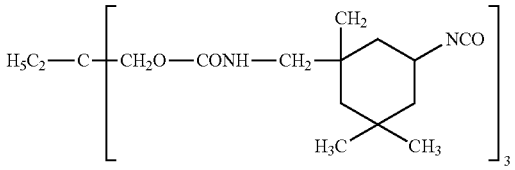

[Compound D]

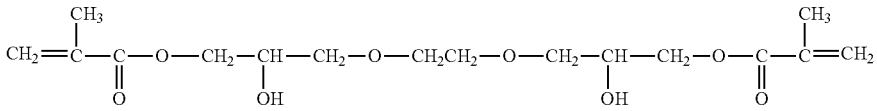

[Compound E]

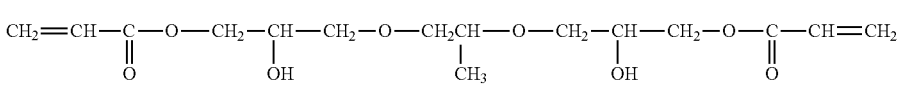

[Compound F]

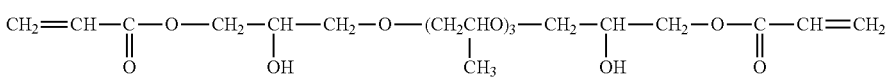

The commercially available aliphatic urethane oligomer acrylate having no hydroxyl group includes MIRAMERPU2034C (Miwon specialty chemical), acryl difunctionality, MW 2,500; MIRAMERPU2100 (Miwon specialty chemical), acryl difunctionality, MW 1,400; MIRAMERPU2200 (Miwon specialty chemical), acryl difunctionality, MW 2,000; MIRAMERPU5000 (Miwon specialty chemical), acryl hexafunctionality, MW 1,800; MiramerPU610 MIRAMERPU610 (Miwon specialty chemical), acryl hexafunctionality, MW 1,800; MIRAMERPU614T (Miwon specialty chemical), acryl hexafunctionality, MW 2,000); MIRAMERPU6140 (Miwon specialty chemical), acryl hexafunctionality, MW 1,500; EBECRYL 8402(SK Cytec), acryl difunctionality, MW 1,000; EBECRYL 4858(SK Cytec), acryl difunctionality, MW 450; EBECRYL 1290(SK Cytec), acryl hexafunctionality, MW 1,000; UP111(SK Cytec), acryl decafunctionality, MW 1,000; and the like.

The modified perfluoropolyether acrylate may be present in a state of being bonded in the protective layer 330, by being crosslinked with the urethane oligomer acrylate in the protective layer 330 thermal curing. That is, since the fluorine-based compound is not present in a state of being isolated in the outside of the protective layer 330, the fluorine-based compound is not exfoliated or omitted, and generates a semi-permanent pollution-resistant effect even in the case of being frictionized with the charging roller or developing roller on the surface of the protective layer 330, and increases friction resistance, scratch resistance and hardness of the protective layer 330.

The modified perfluoropolyether acrylate has perfluoroalkylene ether having an acryl or methacryl group as a reactive functional group, as a repeating unit. As the perfluoroalkylene ether repeating unit, repeating units, for example, perfluoromethylene ether, perfluoroethylene ether or perfluoropropylene ether. Though not limited thereto, as an example, the modified perfluoropolyether acrylate has a repeating structure unit represented by the following Chemical Formula G, or a repeating structure unit represented by the following Chemical Formula H:

[Chemical Formula G]

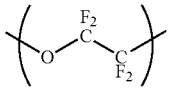

[Chemical Formula H]

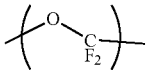

The commercially available modified perfluoropolyether acrylate may include OPTOOL DAC-HP (Daikin); Fluorolink MD700 (Solvay); Fluorolink 5101X(Solvay); and the like.

Meanwhile, the protective layer 330 may include 5 to 40 parts by weight of the modified perfluoropolyether acrylate relative to 100 parts by weight of urethane oligomer acrylate.

When the ratio condition of the composition is satisfied, the protective layer 330 may have appropriate hardness and toughness. The hardness refers to consistency, i.e., surface strength of an object, and the toughness refers to a property that an object stretches and spreads well with resistance produced when a material is plastic-deformed. The protective layer having unduly high hardness may cause light exposure potential rise, and the protective layer having unduly high toughness may cause that the toner is not developed to the photosensitive body and remains in the developing roller, that is, toner filming.

Meanwhile, for example, the urethane oligomer acrylate included in the protective layer 330 includes a mixture of urethane oligomer acrylates having the different number of functional groups from each other. For example, the urethane oligomer acrylate may include a difunctional urethane oligomer acrylate and a trifunctional or higher urethane oligomer acrylate. As such, in the case of using the mixture of the urethane oligomer acrylates having the different number of functional groups, the protective layer 330 may have appropriate hardness and toughness, as compared with using the urethane oligomer acrylate having the certain number of functional groups alone. For example, in the case of using a hexafunctional urethane oligomer acrylate alone, light exposure potential rise may be caused by unduly increased hardness of the protective layer, and in the case of using a difunctional urethane oligomer acrylate alone, toner filming may be caused by unduly increased toughness.

In this case, the urethane oligomer acrylate may be selected from those having a weight average molecular weight of 450 to 2500.

Meanwhile, the protective layer 330 according to the present disclosure may include an aliphatic hydrocarbon acrylate having 16 or more carbon atoms. By using the aliphatic hydrocarbon acrylate having 16 or more carbon atoms, water repellency may be increased.

As the example of the aliphatic hydrocarbon acrylate having 16 or more carbon atoms, the following may be used, but not limited thereto:

stearyl acrylate

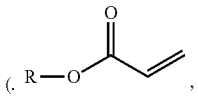

R:C18H37, CAS NO. 4813-57-4), stearyl methacrylate

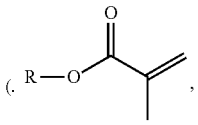

R:C18H37, CAS NO. 32360-05-7).

The stearyl acrylate or stearyl methacrylate is available from SA-001 (Hannong chemicals), SEM-001 (Hannong chemicals), and SR257C (Satomer).

Meanwhile, the protective layer 330 according to the present disclosure may include a mercapto compound having a photocurable functional group of 'SH—'. By including the mercapto compound, surface hardness may be increased, thereby decreasing hydrophilicity of the protective layer 330.

The mercapto compound is illustrative, and not limited thereto, however, the following may be used:

Tetraethylene glycol bis (3-mercaptopropionate), SH difunctionality, (EGMP-4, SC Organic Chemical Co.), CAS No. 68891-92-9; trimethylolpropane tris (3-mercaptopropionate), SH trifunctionality (TMMP, SC Organic Chemical Co.), CAS No. 33007-83-9; tris[3-mercaptopropionyloxy)- ethyl]-isocyanurate, SH trifunctionality (TEMPIC, SC Organic Chemical Co.), CAS No. 36196-44-8; pentaerythritol tetrakis (3-mercaptopropionate), SH tetrafunctionality (PEMP, SC Organic Chemical Co.), CAS NO. 7575-23-7).

Meanwhile, a photoinitiator used in the protective layer composition solution may be used without limitation, as long as it is an actinic ray generating an active species capable of initiating polymerization of the above-described photocurable material by exposure to light such as visible light, ultraviolet ray, far ultraviolet ray and charged particle ray. For example, an O-acyloxime-based compound, an acetophenone-based compound, a biimidazole-based compound, a benzoin-based compound, a benzophenone-based compound, an α-diketone-based compound, a polynuclear quinone-based compound, a xanthone-based compound, a phosphine-based compound, a triazine-based compound and the like may be listed.

Further, the solvent used in the protective layer composition solution includes, though not limited thereto, aromatic hydrocarbons such as benzene, xylene, ligroin, monochlorobenzene and dichlorobenzene; ketones such as acetone, methylethyl ketone and cyclohexanone; alcohols such as methanol, ethanol, 1-propanol, isopropanol, n-propanol and n-butanol; esters such as ethyl acetate and methyl cellosolve; aliphatic halogenated hydrocarbones such as carbon tetrachloride, chloroform, dichloroethane, dichloromethane and trichloroethylene; ethers such as tetrahydrofuran, dioxane, dioxolane, ethylene glycol monomethyl ether; amides such as N,N-dimethyl formamide and N,N-dimethyl acetamide; sulfoxides such as dimethylsulfoxide, and the like. These solvents may be used alone, or in a mixture of two or more.

The protective layer 330 has a curable resin as a main component, which may have an insulating property, and thus, has higher electrical resistance. For solving this the protective layer 330 may further include conductive particles, such as metal particles and/or conductive metal oxide particles.

The conductive particles are not particularly limited to the following, and may be one or more kinds of materials selected from copper, tin, aluminum, indium, silica, tin oxide, zinc oxide, titanium dioxide, aluminum oxide ($Al_2O_3$), zirconium oxide, indium oxide, antimony oxide, bismuth oxide, calcium oxide, Antimony-dopped tin oxide (antimony tin oxide, ATO) and carbon nanotubes.

The protective layer 330 may be formed by coating, drying and photocuring of the protective layer composition solution on the photosensitive layer. First, the coating method is not particularly limited, and dip coating, spray coating, spin coating, wire bar coating, ring coating and the like in the art may be used. After evaporating the solvent by drying it after coating, photocuring may be carried out by using a photocuring system such as, for example, ultraviolet curing. When the actinic ray is irradiated, radicals are generated to cause polymerization, and intermolecular and intramolecular crosslinking is formed by the crosslinking reaction occurring intermolecularly and intramolecularly to form a curing product. As the actinic ray, an ultraviolet ray or electron beam may be used, and as the irradiator, a ultraviolet ray irradiator or an electron ray irradiator in the art may be properly used to form the protective layer.

The photosensitive body 300 may be rotated for uniform curing. The rotation speed may be for example, about 5 to 40 rpm. The curing time varies depending on the thickness of the protective layer and the rotation speed of the photosensitive body, but may be about 20 to about 100 seconds. When the curing time satisfies the range of about 20 to about 100 seconds, incomplete or excessive curing may be avoided, thereby avoiding damage to the photosensitive body, or decreased sensitivity characteristics of the photosensitive body.

The above-described photosensitive body having the protective layer according to the present disclosure may reduce the influence of moisture, and have improved durability of the mechanical properties such as crushing resistance, scratch resistance and abrasion resistance. Accordingly, the present photosensitive body may stably provide a higher quality image over a long period of time even in the case of repeated use.

Hereinafter, the present disclosure will be described in detail using various examples, however, examples are not limited thereto. Meanwhile, the Examples and Comparative Examples described below are all for describing the present disclosure, and the Comparative Examples do not mean the prior art.

Example 1

A conductive dispersion was prepared by adding 200 parts by weight of 0.3 mmΦ zirconia beads to 65 parts by weight of n-propanol, then adding 35 parts by weight of conductive inorganic particles ATO (antimony doped $SnO_2$) (available from Ishihara Sangyo, product name: FS-10P) thereto, dispersing the mixture in a paint shaker for 8 hours, and then diluting it with 77 parts by weight of ethylene glycol monomethyl ether. Again, 15 parts by weight of the prepared conductive dispersion, 9.5 parts by weight of a hexafunctional aliphatic urethane oligomer acrylate (available from SK Cytec, product name: EBECRYL 1290), 2.5 parts by weight of a difunctional aliphatic urethane oligomer acrylate (available from SK Cytec, product name: EBECRYL 8402), and 0.1 parts by weight of a photoinitiator were dissolved in 20 parts by weight of n-propanol and 52 parts by weight of ethylene glycol monomethyl ether for 3 hours to prepare a protective layer composition. This composition was coated on a general laminate type organic photosensitive body by a dip coating method, and dried for 5 minutes in a 65° C. oven. After drying, the photosensitive body was cured while rotating by a ultraviolet curing device, and herein the rotation speed of the photosensitive body was 30 rpm, a metal halide type was used as the ultraviolet lamp, and the energy irradiated for curing was about 1100 mJ/cm$^2$. The protective layer of the thus-prepared electrophotographic photosensitive body had a thickness of about 1.2 μm.

Example 2

A photosensitive body was prepared in the same manner as in Example 1, except that in the protective layer composition, 10 parts by weight of a modified perfluoropolyether acrylate (available from Daikin, product name: OPTOOL DAC-HP) relative to 100 parts by weight of the urethane oligomer acrylate was dissolved.

Example 3

A photosensitive body was prepared in the same manner as in Example 1, except that in the protective layer composition, 10 parts by weight of a modified perfluoropolyether acrylate (available from Daikin, product name: OPTOOL DAC-HP) relative to 100 parts by weight of the urethane oligomer acrylate was dissolved in 9.5 parts by weight of a hexafunctional aliphatic urethane oligomer acrylate (available from Miwon specialty chemical, product name: MIRAMERPU5000), and 2.5 parts by weight of a difunctional aliphatic urethane oligomer acrylate (available from Miwon specialty chemical, product name: MiramerPU2304).

Example 4

A photosensitive body was prepared in the same manner as in Example 1, except that in the protective layer composition, 10 parts by weight of a modified perfluoropolyether acrylate (available from Daikin, product name: OPTOOL DAC-HP) relative to 100 parts by weight of the urethane oligomer acrylate was dissolved in 9.5 parts by weight of a hexafunctional aliphatic urethane oligomer acrylate (available from Miwon specialty chemical, product name: MIRAMERPU6100) and 2.5 parts by weight of a difunctional aliphatic urethane oligomer acrylate (available from Miwon specialty chemical, product name: MIRAMERPU2100).

Example 5

A photosensitive body was prepared in the same manner as in Example 1, except that in the protective layer composition, 10 parts by weight of a modified perfluoropolyether acrylate (available from Daikin, product name: OPTOOL DAC-HP) relative to 100 parts by weight of the urethane oligomer acrylate was dissolved in 9.5 parts by weight of a decafunctional aliphatic urethane oligomer acrylate (available from SK Cytec, product name: UP111) and 2.5 parts by weight of a difunctional aliphatic urethane oligomer acrylate (available from SK Cytec, product name: EBECRYL 4858).

Example 6

A photosensitive body was prepared in the same manner as in Example 1, except that in the protective layer composition, 5 parts by weight of a modified perfluoropolyether acrylate (available from Daikin, product name: OPTOOL DAC-HP) relative to 100 parts by weight of the urethane oligomer acrylate was dissolved.

Example 7

A photosensitive body was prepared in the same manner as in Example 1, except that in the protective layer composition, 20 parts by weight of a modified perfluoropolyether acrylate (available from Daikin, product name: OPTOOL DAC-HP) relative to 100 parts by weight of the urethane oligomer acrylate was dissolved.

Example 8

A photosensitive body was prepared in the same manner as in Example 1, except that in the protective layer composition, 30 parts by weight of a modified perfluoropolyether acrylate (available from Daikin, product name: OPTOOL DAC-HP) was dissolved in 100 parts by weight of a urethane oligomer acrylate.

Example 9

A photosensitive body was prepared in the same manner as in Example 1, except that in the protective layer composition, 40 parts by weight of a modified perfluoropolyether acrylate (available from Daikin, product name: OPTOOL DAC-HP) relative to 100 parts by weight of the urethane oligomer acrylate was dissolved.

Example 10

A photosensitive body was prepared in the same manner as in Example 1, except that in the protective layer composition, 8.3 parts by weight of stearyl monoacrylate (available from Hannong chemicals, product name: SA-001) relative to100 parts by weight of the urethane oligomer acrylate was dissolved.

Example 11

A photosensitive body was prepared in the same manner as in Example 1, except that in the protective layer composition, 8.3 parts by weight of stearyl methacrylate (available from Hannong chemicals, product name: SEM-001) relative to 100 parts by weight of a urethane oligomer acrylate was dissolved.

Example 12

A photosensitive body was prepared in the same manner as in Example 1, except that in the protective layer composition, 6 parts by weight of a hexafunctional aliphatic urethane oligomer acrylate (available from SK Cytec, product name: EBECRYL 1290) alone, and 100 parts by weight of SH tetrafunctionality (available from SC Organic Chemicals, product name: PEMP) relative to 100 parts by weight of the urethane oligomer acrylate were dissolved.

Example 13

A photosensitive body was prepared in the same manner as in Example 1, except that in the protective layer composition, 4.8 parts by weight of a hexafunctional aliphatic urethane oligomer acrylate (available from SK Cytec, product name: EBECRYL 1290), 1.2 parts by weight of a difunctional aliphatic urethane oligomer acrylate (available from SK Cytec, product name: EBECRYL 8402), and 100 parts by weight of SH tetrafunctionality (available from SC Organic Chemicals, product name: PEMP) relative to 100 parts by weight of the urethane oligomer acrylate were dissolved.

Comparative Example 1

A photosensitive body was prepared in the same manner as in Example 1, except that in the protective layer composition, 12 parts by weight of a pentafunctional dipentaerythritol pentaacrylate, DPPA having a hydroxyl group (available from Satomer, product name: 399LV) alone was dissolved.

Comparative Example 2

A photosensitive body was prepared in the same manner as in Comparative Example 1, except that in the protective layer composition, 0.06 parts by weight of a difunctional Si-based polymerizable compound (available from BYK, product name: BYK-UV3500) was dissolved.

Comparative Example 3

A photosensitive body was prepared in the same manner as in Example 1, except that in the protective layer composition, 0.06 parts by weight of a difunctional Si-based polymerizable compound (available from BYK, product name: BYK-UV3500) was dissolved.

Comparative Example 4

A photosensitive body was prepared in the same manner as in Comparative Example 1, except that in the protective layer composition, 10 parts by weight of a modified perfluoropolyether acrylate (available from Daikin, product name: OPTOOL DAC-HP) relative to 100 parts by weight of the photocurable compound was dissolved.

Comparative Example 5

A photosensitive body was prepared in the same manner as in Example 1, except that in the protective layer composition, 12 parts by weight of a hexafunctional aliphatic urethane oligomer acrylate (available from SK Cytec, product name: EBECRYL 1290) was dissolved.

Comparative Example 6

A photosensitive body was prepared in the same manner as in Example 1, except that in the protective layer composition, 12 parts by weight of a difunctional aliphatic urethane oligomer acrylate (available from SK Cytec, product name: EBECRYL 8402) was dissolved.

Comparative Example 7

A photosensitive body was prepared in the same manner as in Example 1, except that in the protective layer composition, 2.5 parts by weight of stearyl monoacrylate (available from Hannong chemicals, product name: SA-001) relative to 100 parts by weight of the urethane oligomer acrylate was dissolved.

Comparative Example 8

A photosensitive body was prepared in the same manner as in Example 1, except that in the protective layer composition, 2.5 parts by weight of a hexafunctional aliphatic urethane oligomer acrylate (available from SK Cytec, product name: EBECRYL 1290) alone, and 380 parts by weight of SH tetrafunctionality (available from SC Organic Chemicals, product name: PEMP) relative to 100 parts by weight of a urethane oligomer acrylate were dissolved.

Comparative Example 9

A photosensitive body was prepared in the same manner as in Example 1, except that in the protective layer composition, 3 parts by weight of a modified perfluoropolyether acrylate (available from Daikin, product name: OPTOOL DAC-HP) relative to 100 parts by weight of the urethane oligomer acrylate was dissolved.

Comparative Example 10

A photosensitive body was prepared in the same manner as in Example 1, except that in the protective layer composition, 45 parts by weight of a modified perfluoropolyether acrylate (available from Daikin, product name: OPTOOL DAC-HP) relative to 100 parts by weight of the urethane oligomer acrylate was dissolved.

Comparative Example 11

A photosensitive body was prepared in the same manner as in Example 1, except that in the protective layer composition, 50 parts by weight of a modified perfluoropolyether acrylate (available from Daikin, product name: OPTOOL DAC-HP) relative to 100 parts by weight of the urethane oligomer acrylate was dissolved.

The above Examples and Comparative Examples are summarized in the following Table 1:

TABLE 1

| | Photocurable compound | | | |
|---|---|---|---|---|
| Example | Composition1 | Composition 2 | Composition 3 | Parts by weight of composition 3 relative to 100 parts by weight of compounds 1 and 2 |
| Example 1 | U-Oligomer1 | U-Oligomer2 | — | — |
| Example 2 | U-Oligomer3 | U-Oligomer2 | PFPE | 10 |
| Example 3 | U-Oligomer5 | U-Oligomer4 | PFPE | 10 |
| Example 4 | U-Oligomer7 | U-Oligomer6 | PFPE | 10 |
| Example 5 | U-Oligomer1 | U-Oligomer8 | PFPE | 10 |
| Example 6 | U-Oligomer1 | U-Oligomer2 | PFPE | 5 |
| Example 7 | U-Oligomer1 | U-Oligomer2 | PFPE | 20 |
| Example 8 | U-Oligomer1 | U-Oligomer2 | PFPE | 30 |
| Example 9 | U-Oligomer1 | U-Oligomer2 | PFPE | 40 |
| Example 10 | U-Oligomer1 | U-Oligomer2 | S-AC1 | 8.3 |
| Example 11 | U-Oligomer1 | U-Oligomer2 | Stearyl AC2 | 8.3 |
| Example 12 | U-Oligomer1 | — | PEMP | 100 |
| Example 13 | U-Oligomer1 | U-Oligomer2 | PEMP | 100 |
| Comparative Example 1 | DPPA | — | — | — |
| Comparative Example 2 | DPPA | — | Si-based | 0.06 |
| Comparative Example 3 | U-Oligomer1 | U-Oligomer2 | Si-based | 0.06 |
| Comparative Example 4 | DPPA | — | PFPE | 10 |
| Comparative Example 5 | U-Oligomer1 | — | — | — |
| Comparative Example 6 | — | U-Oligomer2 | — | — |
| Comparative Example 7 | U-Oligomer1 | U-Oligomer2 | S-AC1 | 2.5 |
| Comparative Example 8 | U-Oligomer1 | — | PEMP | 380 |
| Comparative Example 9 | U-Oligomer1 | U-Oligomer2 | PFPE | 3 |
| Comparative Example 10 | U-Oligomer1 | U-Oligomer2 | PFPE | 45 |
| Comparative Example 11 | U-Oligomer1 | U-Oligomer2 | PFPE | 50 |

In Table 1, U-Oligomer1 refers to '9.5 parts by weight of a hexafunctional aliphatic urethane oligomer acrylate (available from SK Cytec, product name: EBECRYL 1290)', U-Oligomer2 refers to '2.5 parts by weight of difunctional aliphatic urethane oligomer acrylate (available from SK Cytec, product name: EBECRYL 8402)', U-Oligomer3 refers to '9.5 parts by weight of a hexafunctional aliphatic urethane oligomer acrylate (available from Miwon specialty chemical, product name: MIRAMERPU5000)', U-Oligomer4 refers to '2.5 parts by weight of a difunctional aliphatic urethane oligomer acrylate (available from Miwon specialty chemical, product name: MIRAMERPU2304), U-Oligomer5 refers to '9.5 parts by weight of a hexafunctional aliphatic urethane oligomer acrylate (available from Miwon specialty chemical, product name: MIRAMERPU6100), U-Oligomer6 refers to '2.5 parts by weight of a difunctional aliphatic urethane oligomer acrylate (available from Miwon specialty chemical, product name: MIRAMERPU2100), U-Oligomer7 refers to '9.5 parts by weight of a decafunctional aliphatic urethane oligomer acrylate (available from SK Cytec, product name: UP111), and U-Oligomer8 refers to '2.5 parts by weight of a difunctional aliphatic urethane oligomer acrylate (available from SK Cytec, product name: EBECRYL 4858)'. Further, PFPE refers to 'a modified perfluoropolyether acrylate (available from Daikin, product name: OPTOOL DAC-HP)'. Further, 'S-AC1' refers to 'stearyl monoacrylate (available from Hannong chemicals, product name: SA-001)'. Further, Stearyl AC2 refers to 'stearyl methacrylate (available from Hannong chemicals, product name: SEM-001)'. Further, PEMP refers to 'SH tetrafunctionality (available from SC Organic Chemicals, product name: PEMP)'. Further, DPPA refers to '12 parts by weight of a pentafunctional dipentaerythritol pentaacrylate, DPPA (available from Satomer, product name: 399LV). Further, Si-based refers to 'a difunctional Si-based polymerizable compound (available from BYK, product name: BYK-UV3500)'.

The electrical properties of each photosensitive body were measured using Cynthia equipment (available from Gentec, Model 92KSS), and the light exposure potential was measured by applying voltage to the charged potential (Vo) value of −700 V under the measurement conditions of a rotation speed of an OPC drum of 116.7 rpm, an angle between charge and light exposure of 90°, and an angle between light exposure and a potential probe of 35°. Image quality was evaluated by printing using a combination color printer (Samsung Model C8650ND).

TABLE 2

| Characteristics of protective layer | | | | | |
|---|---|---|---|---|---|
| | Photocurable compound | | | | Protective layer |
| Example | Composition 1 | Composition 2 | Composition 3 | 3 parts by weight of composition 3 | surface properties Contact angle (°) |
| Example 1 | U-Oligomer1 | U-Oligomer2 | — | — | 85 |
| Example 2 | U-Oligomer1 | U-Oligomer2 | PFPE | 10 | 105 |
| Example 3 | U-Oligomer3 | U-Oligomer4 | PFPE | 10 | 96 |
| Example 4 | U-Oligomer5 | U-Oligomer6 | PFPE | 10 | 103 |
| Example 5 | U-Oligomer7 | U-Oligomer8 | PFPE | 10 | 100 |
| Example 8 | U-Oligomer1 | U-Oligomer2 | PFPE | 30 | 107 |
| Example 10 | U-Oligomer1 | U-Oligomer2 | Stearyl AC1 | 8.3 | 98 |
| Example 11 | U-Oligomer1 | U-Oligomer2 | Stearyl AC2 | 8.3 | 100 |
| Example 12 | U-Oligomer1 | — | PEMP | 100 | 87 |
| Example 13 | U-Oligomer1 | U-Oligomer2 | PEMP | 100 | 89 |
| Comparative Example 1 | DPPA | — | — | — | 69 |

Referring to Table 2, it is recognized that a contact angle for pure water was increased in Examples 1 to 8, and 10 to 13, as compared with Comparative Example 1, and thus, the urethane oligomer acrylate having no hydroxyl group, the modified perfluoropolyether acrylate, the aliphatic hydrocarbon acrylate, and the mercapto compound are all effective for modifying the surface properties.

TABLE 3

| Characteristics of protective layer | | | | | | |
|---|---|---|---|---|---|---|
| | Photocurable compound | | | | Protective layer | |
| | | | | 3 parts | surface properties | |
| Example | Composition 1 | Composition 2 | Composition 3 | by weight of Composition 3 | Contact angle (°) | Image output |
| Example 1 | U-Oligomer1 | U-Oligomer2 | — | — | 85 | Good |
| Example 2 | U-Oligomer1 | U-Oligomer2 | PFPE | 10 | 105 | Good |
| Example 6 | U-Oligomer1 | U-Oligomer2 | PFPE | 5 | 99 | Good |
| Example 7 | U-Oligomer1 | U-Oligomer2 | PFPE | 20 | 106 | Good |
| Example 8 | U-Oligomer1 | U-Oligomer2 | PFPE | 30 | 107 | Good |
| Example 9 | U-Oligomer1 | U-Oligomer2 | PFPE | 40 | 110 | Good |
| Example 10 | U-Oligomer1 | U-Oligomer2 | S-AC1 | 8.3 | 98 | Good |
| Example 12 | U-Oligomer1 | — | PEMP | 100 | 87 | Good |
| Comparative Example 5 | U-Oligomer1 | — | — | — | 87 | Lowered density |
| Comparative Example 6 | — | U-Oligomer2 | — | — | 82 | Filming |
| Comparative Example 7 | U-Oligomer1 | U-Oligomer2 | S -AC1 | 2.5 | 87 | Good |
| Comparative Example 8 | U-Oligomer1 | — | PEMMP | 380 | 80 | Lowered density |

TABLE 3-continued

| Characteristics of protective layer | | | | | | |
|---|---|---|---|---|---|---|
| | Photocurable compound | | | | Protective layer surface properties | |
| Example | Composition 1 | Composition 2 | Composition 3 | 3 parts by weight of Composition 3 | Contact angle (°) | Image output |
| Comparative Example 9 | U-Oligomer1 | U-Oligomer2 | PFPE | 3 | 98 | Good |
| Comparative Example 10 | U-Oligomer1 | U-Oligomer2 | PFPE | 45 | 116 | CR slip |
| Comparative Example 11 | U-Oligomer1 | U-Oligomer2 | PFPE | 50 | 121 | CR slip |

Table 3 is the results of an initial image of the photosensitive body. Referring to Table 3, it is recognized that the image quality of Example 1 is better than that of Comparative Example 5 using hexafunctionality alone as the photocurable compound, and Comparative Example 6 using a tetrafunctional or lower urethane oligomer alone, which may be explained by the property change of hardness and toughness of the surface cured layer, in particular the relationship between the charge roller and the cleaning blade. Increased hardness of the protective layer causes rising light exposure potential to produce lowered density, and increased toughness of the protective layer causes toner filming.

It was recognized that when 5-40 parts by weight of the modified perfluoropolyether acrylate was used relative to 100 parts by weight of the urethane oligomer acrylate in Comparative Examples 2 and 6 to 9, surface property change and image output results were excellent, as compared with Comparative Examples 9 to 11. In Comparative Example 7 adding 3 parts by weight of composition 3 relative to 100 parts by weight of the urethane oligomer, there was no effective surface property change as compared with Example 10, and in Comparative Example 8 using 100 parts by weight or more, light exposure potential was raised by the excessive increase of a curing degree to produce concentration cloud. Therefore, it is recognized that the added amount of the tetrafunctional or lower urethane oligomer, the aliphatic hydrocarbon acrylate, and the mercapto compound is preferably 8-100 parts by weight relative to 100 parts by weight of the urethane oligomer.

Table 4 shows image results after rotation at 360 kc of the photosensitive body. Referring to Table 4, it is recognized that in Example 1 and Comparative Example 9 using less than 5 parts by weight of the modified perfluoropolyether acrylate, surface property change was insufficient to increase abrasion of the cleaning blade which is a counterpart thereto, thereby causing charging roller contamination (CR contamination) after poor cleaning, which causes a bad image after the life. In Comparative Examples 10 and 11 using more than 40 parts by weight of the modified perfluoropolyether acrylate, it is recognized that the charging roller slip (CR slip) which is an opposite object thereto was caused by excessive change of the surface properties to cause a problem in image output. In addition, referring to Tables 3 and 4, it is recognized that only within the range of 5 to 40 parts by weight of the modified perfluoropolyether acrylate, excellent image properties even after rotation at 360 kc as well as initial image properties were shown.

TABLE 5

| Initial characteristics of photosensitive body | | | | |
|---|---|---|---|---|
| Example | NN light exposure potential (v) | NN image quality | HH image quality | Dot reproducibility |
| Example 1 | 78 | ◎ | ○ | ◎ |
| Example 2 | 76 | ◎ | ◎ | ◎ |
| Example 3 | 81 | ◎ | ◎ | ◎ |
| Example 4 | 76 | ◎ | ◎ | ◎ |
| Example 5 | 78 | ◎ | ◎ | ◎ |
| Example 6 | 75 | ◎ | ◎ | ◎ |
| Example 7 | 73 | ◎ | ◎ | ◎ |
| Example 8 | 73 | ◎ | ◎ | ◎ |
| Example 9 | 70 | ◎ | ◎ | ○ |
| Example 10 | 82 | ◎ | ◎ | ◎ |
| Example 11 | 83 | ◎ | ◎ | ◎ |
| Example 12 | 92 | ◎ | ○ | ◎ |
| Example 13 | 94 | ◎ | ◎ | ◎ |
| Comparative Example 1 | 115 | ◎ | X | ◎ |

TABLE 4

| Characteristics of photosensitive body after rotation at 360 kc | | | | | | | | | |
|---|---|---|---|---|---|---|---|---|---|
| | Example 1 | Example 2 | Example 6 | Example 7 | Example 8 | Example 9 | Comp. Example 9 | Comp. Example 10 | Comp. Example 11 |
| C-blade abrasion (um^2) | 50.9 | 13.4 | 19.1 | 10.3 | 8.6 | 7.9 | 25.4 | — | — |
| Operating Characteristics | CR contamination | Good | Good | Good | Good | Good | CR contamination | Initial CR slip | Initial CR slip |

TABLE 5-continued

| Initial characteristics of photosensitive body | | | | |
|---|---|---|---|---|
| Example | NN light exposure potential (v) | NN image quality | HH image quality | Dot reproducibility |
| Comparative Example 2 | 120 | ◎ | X | X |
| Comparative Example 3 | 81 | ◎ | Δ | X |
| Comparative Example 4 | 110 | ◎ | X | ◎ |
| Comparative Example 9 | 80 | ◎ | ○ | ◎ |
| Comparative Example 10 | 74 | ○ | ○ | X |
| Comparative Example 11 | 75 | Δ | ○ | X |

NN (normal temperature & normal humidity): 23° C., humidity 55%
HH (high temperature & high humidity): 30° C., humidity 85%
◎: acceptable level in image quality items
○: defects in image quality items present but usable quality level in image quality items
X: level in image quality items that is not usable.

Table 5 is the results of an initial image of the photosensitive body. Referring to Table 5, it is confirmed that in Examples 1-13, the image problem due to humidity in the HH environment was improved in all of the Examples, as compared with Comparative Examples 1-4. In addition, it is recognized that dot reproducibility was better than that of Comparative Examples 2, 3, 10 and 11.

TABLE 6

| Characteristics of photosensitive body after rotation at 1000 kc | | | |
|---|---|---|---|
| Example | HH Image quality | Dot reproducibility | Abrasion thickness (μm) |
| Example 2 | ◎ | ◎ | 0.64 |
| Example 4 | ◎ | ◎ | 0.57 |
| Example 6 | ◎ | ◎ | 0.55 |
| Example 7 | ◎ | ◎ | 0.62 |
| Example 8 | ◎ | ◎ | 0.63 |
| Example 9 | ◎ | ○ | 0.54 |
| Example 10 | ◎ | ◎ | 0.66 |
| Example 11 | ◎ | ◎ | 0.56 |
| Example 13 | ◎ | ◎ | 0.52 |
| Comp. Example 1 | Blurred image | X | 0.42 |

Table 6 shows image results after rotation at 1000 kc of the photosensitive body. Referring to Table 6, it is recognized that in the Examples, the photosensitive body maintained normal image even after rotation at 1000 kc, and in Comparative Example 1 having initial HH image flows but good dot reproducibility, the photosensitive body had poor image properties after rotation at 1000 kc. The surface abrasion thickness of the photosensitive body having the protective layer was 0.42-0.66 μm in all of the photosensitive bodies, showing excellent long life characteristics.

FIG. 3 is an SEM image of the photosensitive body manufactured according to an example of the present disclosure.

In FIG. 3, 1 is the protective layer, and 2 is the photosensitive layer. The composition of the protective layer is formed of photocurable compounds such as an aliphatic urethane acrylate, a modified perfluoropolyether acrylate, an aliphatic hydrocarbon acrylate, a reactive material containing a mercapto portion, and composed of various functional groups, and includes a photoinitiator and conductive particles. The charging and light exposure characteristics may be also improved by controlling a distance of the conductive particle aggregates subjected to dispersion. Specifically, the electrical properties may be improved according to the distribution type of the conductive particles. Specifically, for example, the aggregates of the conductive particles formed in the protective layer are formed to have a size of 50-300 nm, and a distance between the aggregates is distributed to be 50-500 nm. As such, by using a combination of the photocurable compounds having various compositions, image quality may be controlled with the life characteristics of the protective layer and the change of the surface properties.

Although the examples of the present disclosure are illustrated and described, the present disclosure is not limited by the above-described, certain examples, and of course, various modifications may be carried out by those with ordinary skill in the art to which the present disclosure pertains, without departing from the gist claimed in the claims, and also, these modifications should not be understood individually from the technical spirits or prospects of the present disclosure.

What is claimed is:

1. A photosensitive body for an image forming apparatus, comprising:

a photosensitive layer supported by a support including a conductive material; and a protective layer formed on the photosensitive layer, wherein the protective layer includes a modified perfluoropolyether acrylate crosslinked with an aliphatic urethane oligomer acrylate having no hydroxyl group.

2. The photosensitive body as claimed in claim 1, wherein the protective layer includes 5 to 40 parts by weight of the modified perfluoropolyether acrylate per 100 parts by weight of the aliphatic urethane oligomer acrylate.

3. The photosensitive body as claimed in claim 1, wherein the aliphatic urethane oligomer acrylate includes at least one acrylate of a difunctional urethane oligomer acrylate or a trifunctional or higher urethane oligomer acrylate.

4. The photosensitive body as claimed in claim 1, wherein the protective layer includes at least one compound of:

an aliphatic hydrocarbon acrylate having 16 or more carbon atoms, or a mercapto compound.

5. The photosensitive body as claimed in claim 4, wherein the protective layer includes the mercapto compound, and the mercapto compound is tetraethylene glycol bis(3-mercaptopropionate), trimethylolpropane tris(3-mercaptopropionate), tris-[(3-mercaptopropionyloxy)-ethyl]-isocyanurate, or pentaerythritol tetrakis(3-mercaptopropionate).

6. The photosensitive body as claimed in claim 1, wherein the protective layer includes conductive particles selected from copper, tin, aluminum, indium, silica, tin oxide, zinc oxide, titanium dioxide, aluminum oxide, zirconium oxide, indium oxide, antimony oxide, bismuth oxide, calcium oxide or carbon nanotubes.

7. An image forming apparatus comprising the photosensitive body as claimed in claim 1.

8. The photosensitive body as claimed in claim 4, wherein the protective layer includes the aliphatic hydrocarbon acrylate having 16 or more carbon atoms, and the aliphatic hydrocarbon acrylate having 16 or more carbon atoms includes at least one of stearyl acrylate or stearyl methacrylate.

9. The photosensitive body as claimed in claim 1, wherein the aliphatic urethane oligomer acrylate is an aliphatic acrylate having no functional group having hydrophilicity.

10. The photosensitive body as claimed in claim 1, wherein the aliphatic urethane oligomer acrylate includes different urethane oligomer acrylates respectively having different numbers of functional groups from each other.

11. The photosensitive body as claimed in claim 1, wherein the protective layer includes conductive particles.

12. A photosensitive body for an image forming apparatus, comprising:

a photosensitive layer supported by a support including a conductive material; and a protective layer formed on the photosensitive layer to protect the photosensitive layer, wherein the protective layer includes a modified perfluoropolyether acrylate crosslinked with an aliphatic urethane oligomer acrylate having no hydroxyl group, wherein the modified perfluoropolyether acrylate is modified to have a perfluoroalkylene ether having an acryl group or a methacryl group, wherein the protective layer includes at least one compound of:

an aliphatic hydrocarbon acrylate having 16 or more carbon atoms, or a mercapto compound, wherein the aliphatic urethane oligomer acrylate is an aliphatic acrylate having no functional group having hydrophilicity.

* * * * *